US010327541B2

(12) United States Patent
Insinna

(10) Patent No.: US 10,327,541 B2
(45) Date of Patent: Jun. 25, 2019

(54) BAR SECTION FOR A PORTABLE MODULAR BAR

(71) Applicant: Nextco Ltd, London (GB)

(72) Inventor: David Insinna, London (GB)

(73) Assignee: Nextco Ltd (GB)

( * ) Notice: Subject to any disclaimer, the term of this patent is extended or adjusted under 35 U.S.C. 154(b) by 0 days.

(21) Appl. No.: 15/699,499

(22) Filed: Sep. 8, 2017

(65) Prior Publication Data

US 2018/0070718 A1 Mar. 15, 2018

(30) Foreign Application Priority Data

Sep. 9, 2016 (GB) ..... 1615369.4

(51) Int. Cl.

| | |
|---|---|
| ***A47B 3/06*** | (2006.01) |
| ***A47F 5/10*** | (2006.01) |
| ***A47F 9/00*** | (2006.01) |
| ***A47B 13/02*** | (2006.01) |
| ***A47B 47/03*** | (2006.01) |

(Continued)

(52) U.S. Cl.

CPC ..... *A47B 3/06* (2013.01); *A47B 13/02* (2013.01); *A47B 47/03* (2013.01); *A47B 87/008* (2013.01); *A47B 96/20* (2013.01); *A47F 5/10* (2013.01); *A47F 9/00* (2013.01); *A47B 96/1475* (2013.01); *A47B 2096/208* (2013.01)

(58) Field of Classification Search

CPC ..... A47B 13/02; A47B 96/20; A47B 43/00; A47B 45/00; A47B 47/00; A47B 47/0091; A47F 9/00

USPC ..... 312/265.2, 265.3, 265.4, 265.5, 265.6

See application file for complete search history.

(56) References Cited

U.S. PATENT DOCUMENTS 3,105,726 A * 10/1963 Jung ..... A47B 17/00 312/195
5,380,083 A * 1/1995 Jones ..... A47B 47/03 312/265.3

(Continued)

FOREIGN PATENT DOCUMENTS

DE 8900642 U1 11/1989
DE 102011112074 A1 3/2013

(Continued)

OTHER PUBLICATIONS

European Patent Office, The International Search Report of the International Searching Authority, Date of Search: Jan. 31, 2017, for Application No. GB1615369.4.

(Continued)

*Primary Examiner* — Daniel J Rohrhoff
(74) *Attorney, Agent, or Firm* — Design IP

(57) ABSTRACT

The present invention relates to a bar section for a portable modular bar comprising a frame portion having spaced upper and lower rails connected by opposing side rails, the upper rail comprising a slot extending into its upper surface, and a display panel portion comprising a hook configured to cooperate with the slot in the frame portion in order to mount the display panel portion on the frame portion. The present invention also relates to a modular bar comprising a front bar section, a side bar section hingedly connected to a side rails of the front bar section, and a cover section having a peripheral lip configured to fit around the upper part of the front and side bar sections.

18 Claims, 10 Drawing Sheets

(51) Int. Cl.

| | |
|---|---|
| ***A47B 87/00*** | (2006.01) |
| ***A47B 96/14*** | (2006.01) |
| ***A47B 96/20*** | (2006.01) |

(56) References Cited

U.S. PATENT DOCUMENTS

| | | | | |
|---|---|---|---|---|
| 6,012,791 | A * | 1/2000 | Benner | H02B 1/301 312/265.2 |
| 6,921,055 | B2 * | 7/2005 | Schnabel | A47B 47/03 248/224.8 |
| 7,654,304 | B2 * | 2/2010 | Wayman | B22D 17/00 164/137 |
| 9,661,922 | B2 * | 5/2017 | Ehmke | A47B 81/00 |
| 2006/0038467 | A1 * | 2/2006 | DeMars | A47F 9/00 312/140.2 |
| 2008/0007900 | A1 * | 1/2008 | Chen | G06F 1/1605 361/807 |
| 2008/0067900 | A1 | 3/2008 | Marshall et al. | |
| 2015/0083683 | A1 * | 3/2015 | Vazquez | A47B 47/0041 211/182 |
| 2016/0320659 | A1 * | 11/2016 | Ma | G02F 1/13 |
| 2017/0156499 | A1 * | 6/2017 | Kane | A47B 96/20 |

FOREIGN PATENT DOCUMENTS

| | | | |
|---|---|---|---|
| EP | 2905554 | A1 | 8/2015 |
| GB | 1370645 | A | 10/1974 |
| GB | 2286960 | A | 6/1995 |
| GB | 2375289 | A | 11/2002 |
| JP | 0965960 | A | 12/2002 |
| JP | 2004180952 | A | 7/2004 |
| WO | 2016110050 | A1 | 7/2016 |

OTHER PUBLICATIONS

European Patent Office, European Search Report, dated Oct. 26, 2017, for Application No. EP17190068.

* cited by examiner

BAR SECTION FOR A PORTABLE MODULAR BAR

TECHNICAL FIELD

The present invention relates to a bar section for a portable modular bar. The present invention also relates to a portable modular bar comprising the bar section.

BACKGROUND

Portable bars are often used to sell products to the public at events where there are no suitable permanent structures. Therefore, the bars must be transported to the location of the event and assembled, used and then disassembled, transported, and stored once the event has finished.

Known portable bars have the problem that they are often heavy and bulky. Therefore, they can be difficult to move and tend to take up a lot of storage space. In addition, it is known for portable bars to be modular in nature so that they can be made more compact during storage. However, these solutions are normally complex and the assembly and disassembly takes an increased amount of time and requires the use of tools.

The present invention provides a modular bar which overcomes the above mentioned problems.

SUMMARY

In accordance with the embodiments of the invention, there is provided a bar section for a portable modular bar comprising a frame portion having spaced upper and lower rails connected by opposing side rails, the upper rail comprising a slot extending into its upper surface, and a display panel portion comprising a hook configured to cooperate with the slot in the frame portion in order to mount the display panel portion on the frame portion.

Preferably, the hook extends in a horizontal direction from the display panel portion and is configured such that a rear surface of the display panel portion contacts the front surface of the frame portion.

The hook may extend in the horizontal direction by a distance substantially equal to the distance between the front surface of the frame portion and the slot.

Preferably, the hook extends horizontally from the rear surface of an upper member of the display frame portion.

In some embodiments, the hook comprises a first portion which extends horizontally from the rear face of the display panel portion and a second portion which extends vertically downwards from a free end of the first portion and is configured to be located in the slot when the display panel portion is mounted on the frame portion.

Preferably, the display panel portion has substantially the same height and width dimensions as the frame portion to substantially entirely cover the frame portion.

In one embodiment, the frame portion may comprise more than one slot and the display panel portion may comprise a hook configured to cooperate with each slot.

Preferably, the lower rail comprises a slot extending into its upper surface and the display panel portion comprises a hook configured to cooperate with the slot in the lower rail.

The lower hook may comprise a first portion extending substantially vertically from a lower member of the display panel frame, a horizontal portion which extends by a distance substantially equal to the distance between the front surface of the frame portion and the slot, and a downwardly extending vertical portion that is configured to be located in the slot when the display panel portion is mounted on the frame portion.

The rails may be tubular.

The bar section may further comprise a display panel configured to be located within the display panel portion.

According to another aspect of the invention, there is provided a modular bar comprising a front bar section, a side bar section hingedly connected to a side rail of the front bar section, and a cover section having a peripheral lip configured to fit around the upper part of the front and side bar sections.

Preferably, the modular bar further comprises a corner section configured to prevent the outward rotation of the side bar section relative to the front bar section and conceal the hinge and side surfaces of the front and side bar sections from view.

The corner section may comprise a hook configured to locate over the hinge.

In one embodiment, a surface of the corner section is flush with the outward facing surface of the front bar section and/or the outward facing surface of the side bar section.

Preferably, the corner section is substantially tubular and comprises a side wall, from whose end surface the hook extends, which overlaps the end surface of an adjacent side wall.

In some embodiments, the hook comprises a first section that extends horizontally from the end surface of the side wall and a second section which extends downwards from the first section such that there is a space between the second section and the end surface of the side wall.

The second section of the hook may extend downwards at an angle to the vertical.

BRIEF DESCRIPTION OF THE DRAWINGS

Embodiments of the invention will now be described, by way of example only, with reference to the accompanying drawings, in which.

DETAILED DESCRIPTION

Figure 1:
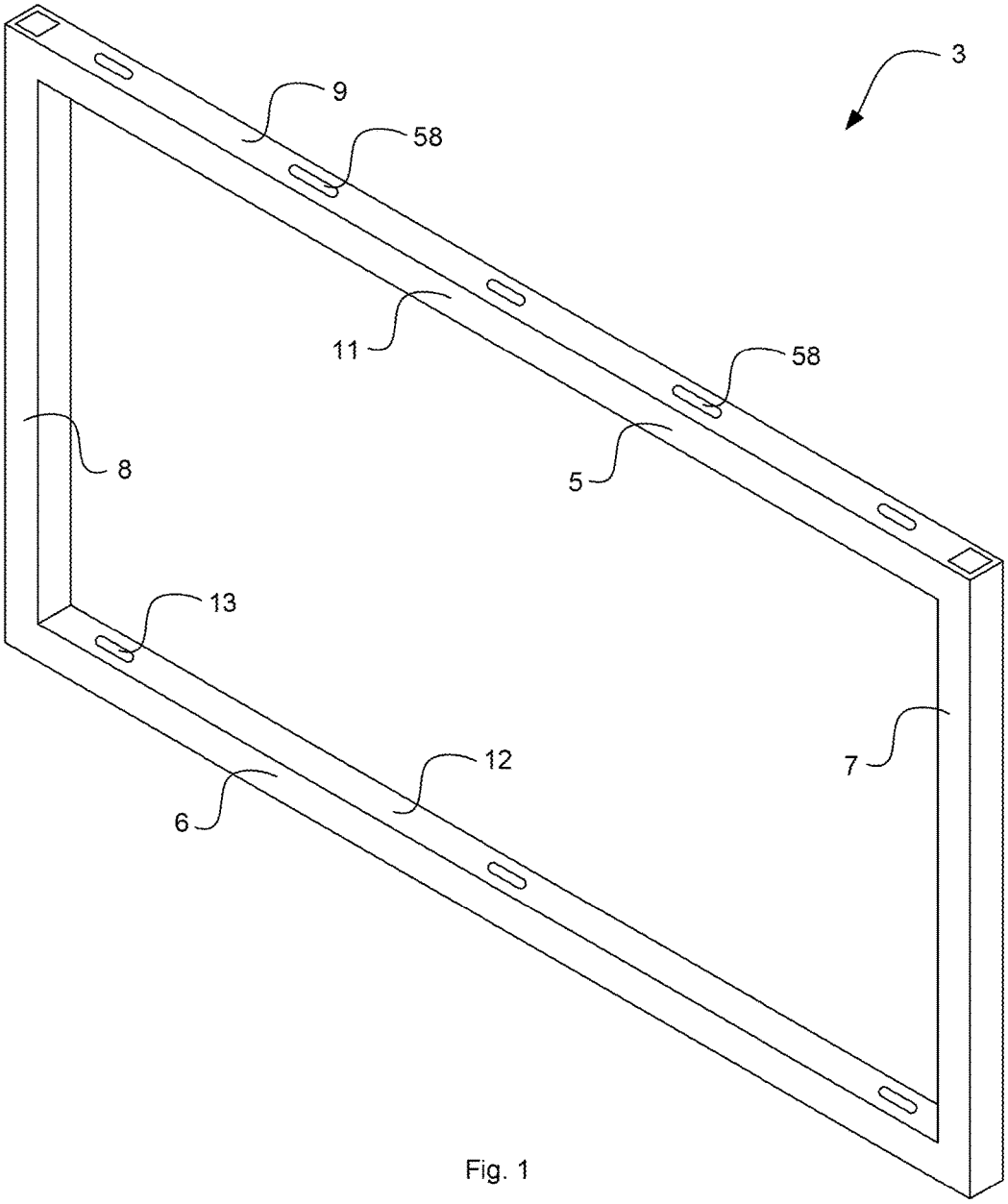
FIG. 1 shows a front perspective view of a frame portion of a modular bar.
Figure 2:
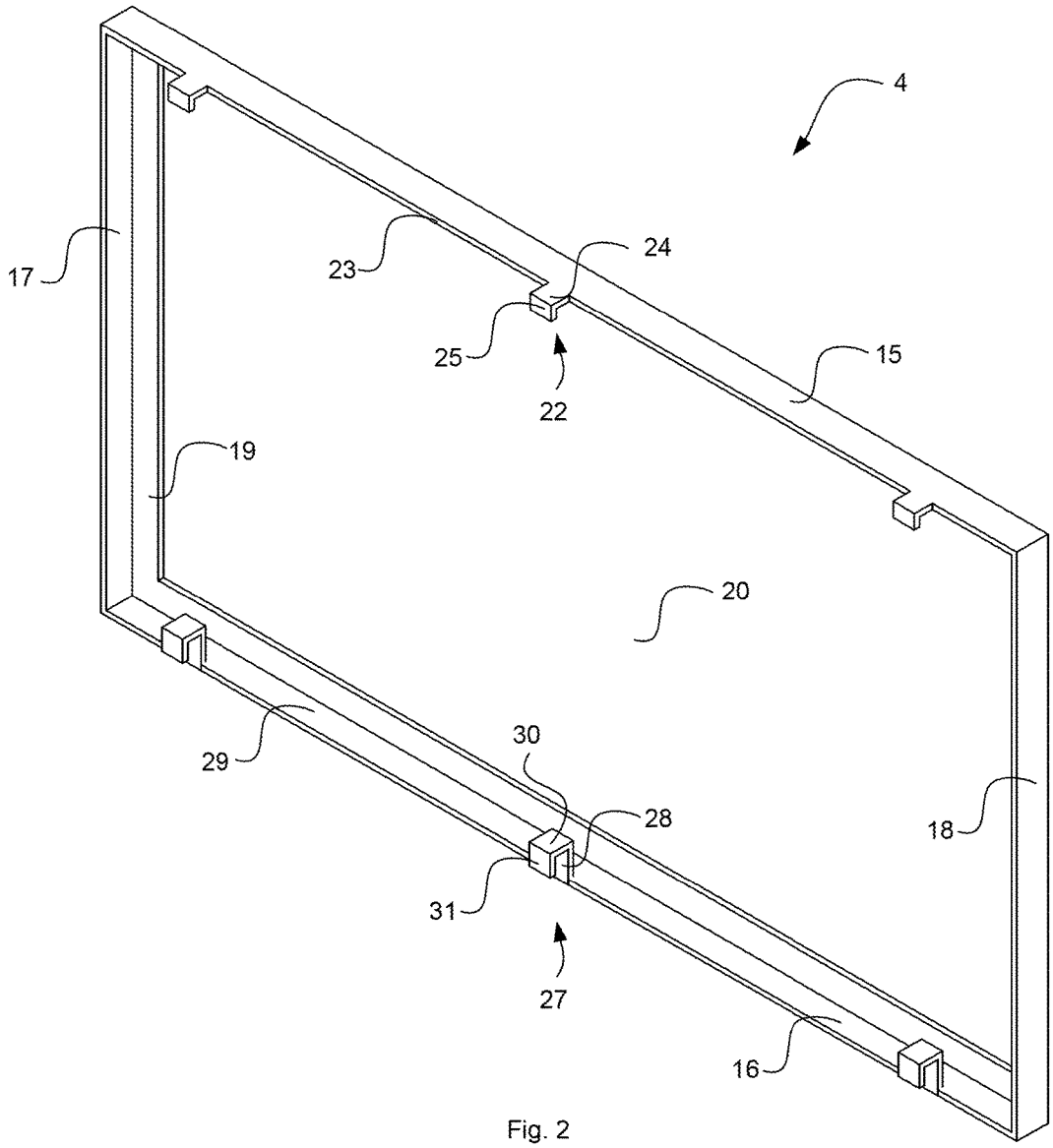
FIG. 2 shows a rear perspective view of a display panel portion of a modular bar.
Figure 12:
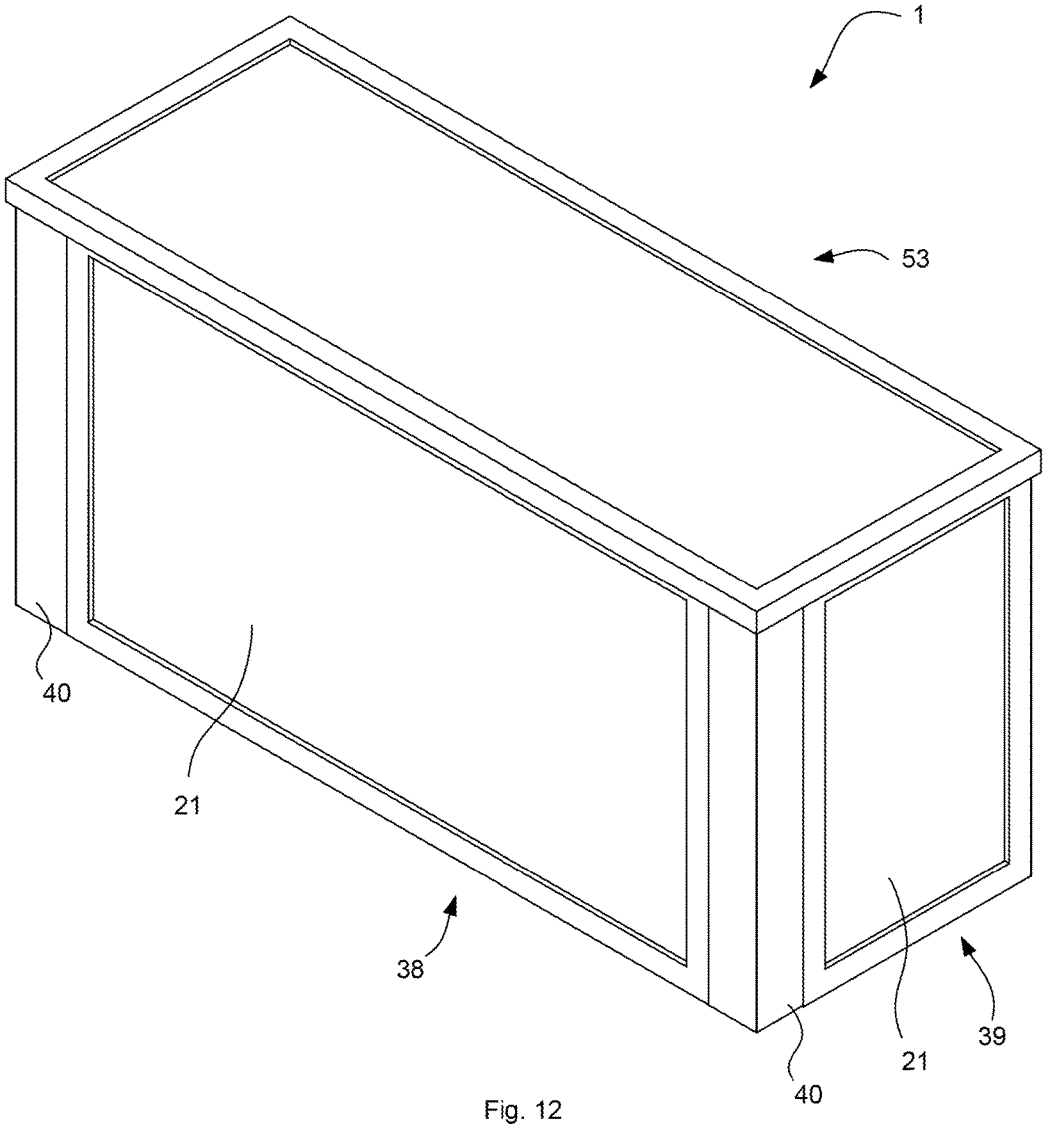
FIG. 12 shows the modular bar of FIG. 10 with a cover in place.

Referring to FIG. 1 and FIG. 2, the main components of a bar section for a portable bar module 1, shown fully assembled in FIG. 12, are shown. The bar section forms a substantially vertical face of the bar module 1. The bar section comprises a frame portion 3, shown in FIG. 1, and a display panel portion 4, shown in FIG. 2.

Figure 3:
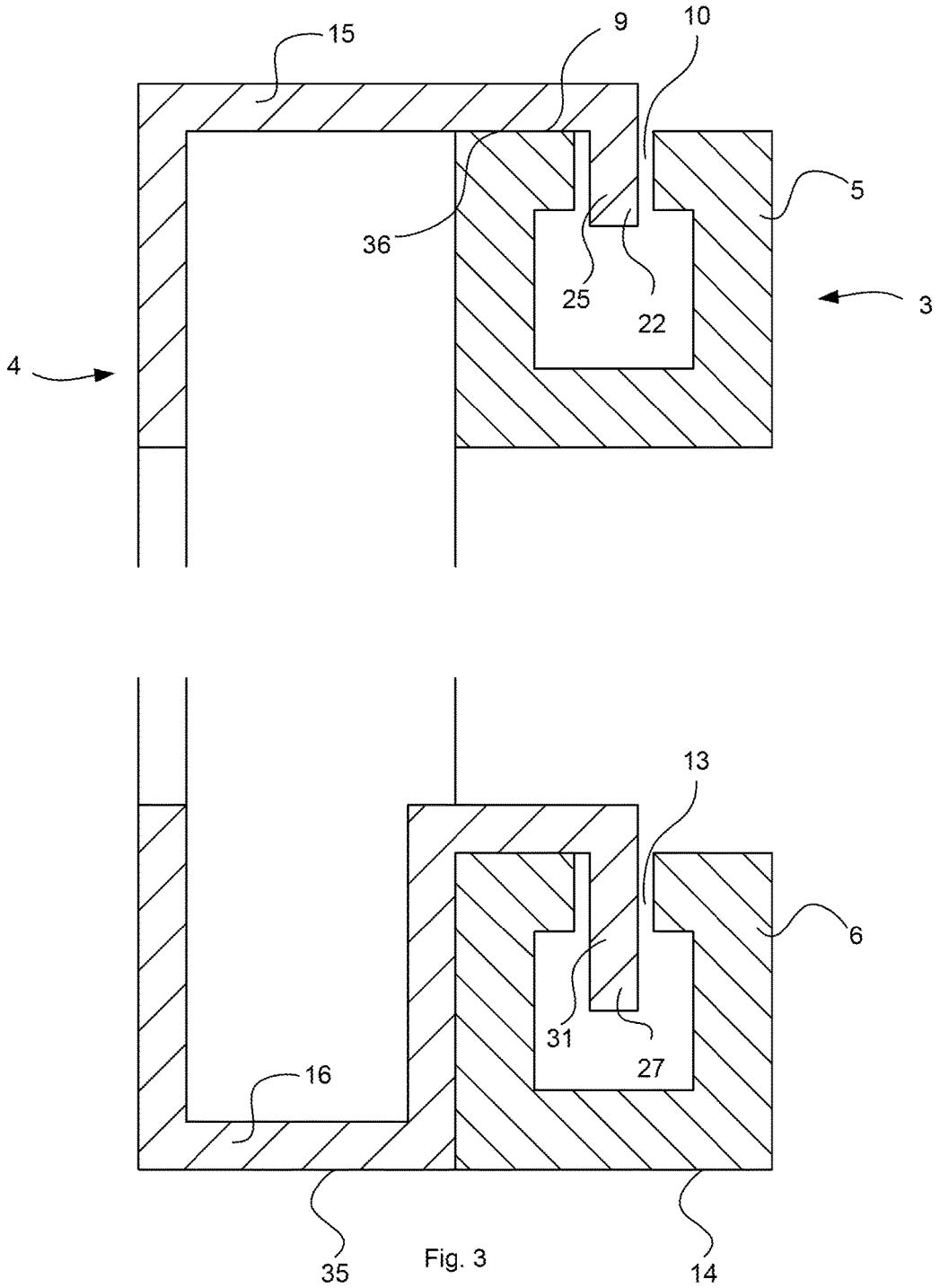
FIG. 3 shows a cross-sectional side view of the display panel portion mounted on the frame portion.

In the present embodiment, the frame portion 3 is generally rectangular and formed of a spaced upper rail 5 and lower rail 6 connected by opposing side rails 7, 8. Each rail 5, 6, 7, 8 is tubular, as shown in FIG. 3, to reduce the weight of the frame portion 3 and has a generally square cross-section, as shown in FIG. 1. The frame portion 3 may be formed from any material, for example, but not limited to, aluminium, steel, or plastic. The thickness of the tubular rails 5, 6, 7, 8 may be in the region of 10 mm to 60 mm.

An upper surface 9 of the upper rail 5 comprises a slot 10, midway between a front surface 11 and a rear surface (not shown), extending into the upper rail 5 which is configured to cooperate with the display panel portion 4, as will be described hereinafter. The slot 10 is generally rectangular and has semi-circular opposing ends but may take alternate forms. In the present embodiment, the upper rail 5 comprises more than one slot 10 spaced along its upper surface 9.

As shown in FIG. 1, an upper surface 12 of the lower rail 6 may also comprise at least one slot 13 configured to cooperate with the display panel portion 4. A lower surface 14, shown in FIG. 3, of the lower rail 6 may also comprise feet (not shown) for contacting the surface on which the frame portion 3 is placed. The feet may be attachable or integrally formed. The feet may be adjustable to give the portable bar module 1 stability and ensure its cover 53, described in detail hereinafter, is level when on uneven ground. Alternatively, the feet may be omitted and the lower surface 14 of the lower rail 6 may be placed in contact with the surface on which the frame portion 3 is placed.

Although the embodiment described and shown in the drawings comprises a frame portion 3 having tubular rails 5, 6, 7, 8 having a square cross-section, it will be understood that in alternative embodiments the cross-sections of the tubular rails 5, 6, 7, 8 may take any other appropriate form, such as, but not limited to, triangular, rectangular, and circular. Furthermore, the cross-sections of the slots 10, 13 may be of different sizes, as shown in FIG. 1, or may take any other appropriate form in alternative embodiments.

Referring now to FIG. 2, a rear perspective view of the display panel portion 4 is shown. The display panel portion 4 comprises a spaced upper member 15 and lower member 16 connected by opposing side members 17, 18. The members 15, 16, 17, 18 are thin and elongate. The display panel portion 4 further comprises a border 19 which extends inwardly from the front faces of each member 15, 16, 17, 18 towards the opposing member 15, 16, 17, 18 of the display panel portion 4. Therefore, the border 19 forms a rectangular shape with a rectangular aperture 20. The border 19 extends perpendicularly to the members 15, 16, 17, 18 and is also thin and elongate. However, it will be understood that in an alternative embodiment, the members may be generally L-shaped so as to integrally form a section of the border 19 and one of the members, for example, the upper member 15. Furthermore, in another alternative embodiment, all the members 15, 16, 17, 18 and the border may be formed integrally. It will also be understood that the border 19 may be configured such that the aperture 20 forms a different shape or multiple shapes, for example, but not limited to, squares, circles, or triangles.

Figure 6:
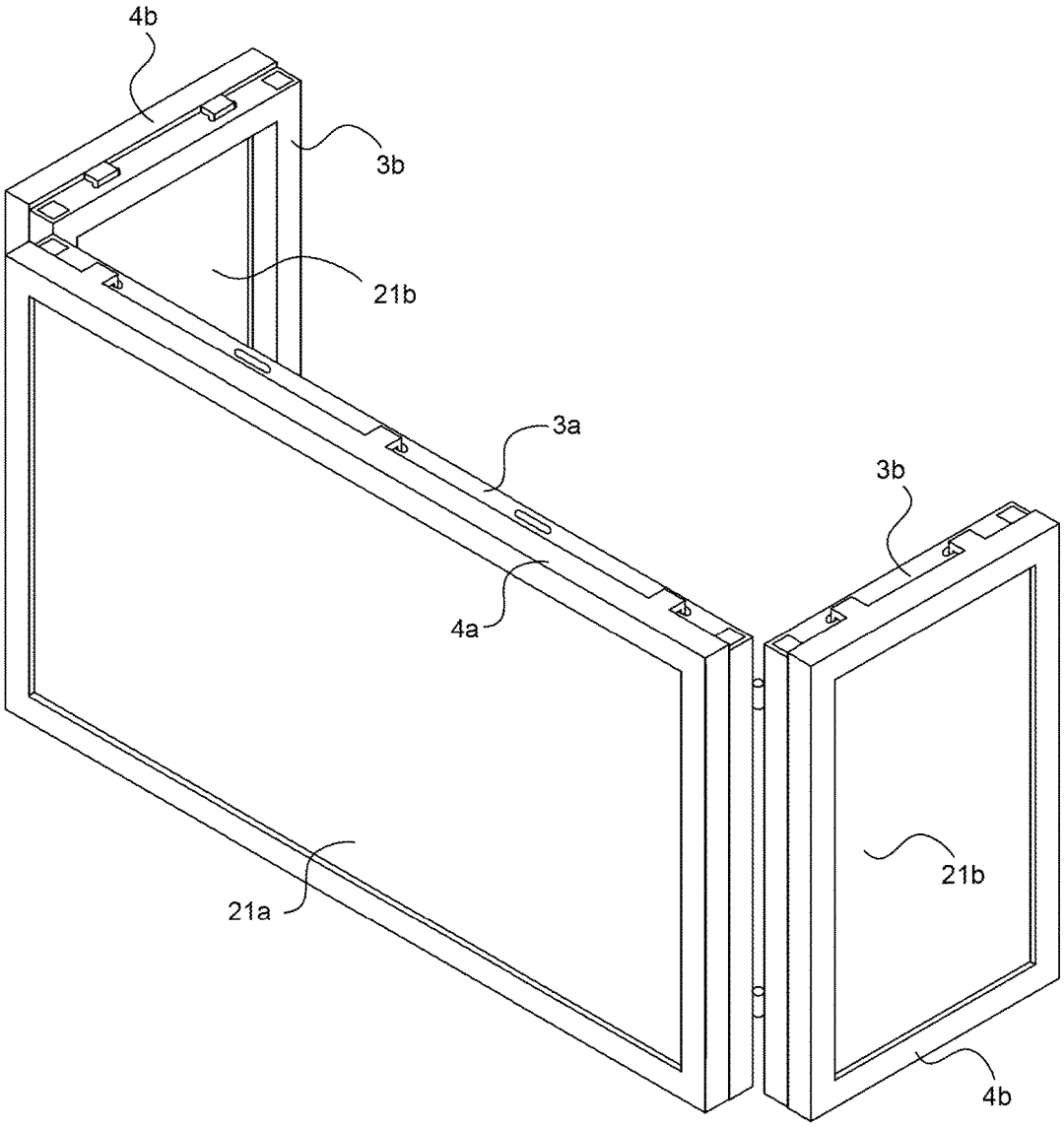
FIG. 6 shows the modular bar of FIG. 5 with display panels in the display panel portions with the positioning bar omitted.

The aperture 20 is configured so that a display panel 21, shown in FIG. 6 can be seen when it is located in the display panel portion 4. The display panel 21 may be held in place by attachment means well known to a person skilled in the art, for example, but not limited to, magnets, hooks, and clips. Therefore, the display panels 21 in the display panel portion 4 may be interchanged depending on the function that the bar module 1 is being used for. For example, the display panels 21 may be different colours and/or made of various materials.

Referring back to FIG. 2, the display panel portion 4 further comprises an upper hook 22 which extends in a horizontal direction from the rear surface 23 of the upper member 15. The upper hook 22 is configured to cooperate with the slot 10 in the upper rail 5 of the frame portion 3, shown in FIG. 1. In the present embodiment, the upper hook portion 22 has a first portion 24 which extends horizontally and a second portion 25 extending perpendicularly to the first portion 24 and configured to be located in the slot 10 when the display panel portion 4 is attached to the frame portion 3, as will be described in more detail hereinafter. The first portion 24 of the hook 22 extends horizontally to minimise the height difference between the display frame portion 4 and the frame portion 3. However, it will be understood that in an alternative embodiment the geometry of the hook 22 may differ. As shown in FIG. 2, more than one upper hook 22 may extend from the rear surface 23 of the upper member 15. Each hook 22 is spaced along the upper member 15 so that it aligns with a slot 10 in the upper rail 5 for attaching the display panel portion 4 to the frame portion 3.

The display panel portion 4 further comprises a lower hook 27 which extends from the lower member 16. The lower hook 27 is configured to cooperate with the slot 13 in the lower rail 6 of the frame portion 3, shown in FIG. 1. In the present embodiment, the lower hook 27 comprises a first portion 28 extending vertically upwards from an upper surface 29 of the lower member 16. The lower hook 27 further comprises a horizontal portion 30 and a downwardly extending vertical portion 31 that resemble the first and second portions 24, 25 of the upper hook 22. As shown in FIG. 2, more than one lower hook 27 may extend from the lower member 16. Each hook 27 is spaced along the lower member 16 so that it aligns with a slot 13 in the lower rail 6 for attaching the display panel portion 4 to the frame portion 3.

In an alternative embodiment, the lower hook 27 may have a different geometry, for example, the lower hook 27 may be curved. In yet another alternative embodiment, the lower hook 27 may be a strip of material that extends from a rear surface 32 of the lower member 16 and has been bent upwards such that the first portion 28 does not extend rearwards of the lower member 16. Slits (not shown) may be required in the lower member 16 to allow the hook 27 to be bent into shape without structural failure of the material.

Referring now to FIG. 3, a cross-sectional side view of the display panel portion 4 attached to the frame portion 3 is shown. FIG. 3 shows that a lower surface 35 of the lower member 16 is flush with the lower surface 14 of the lower member 6 when the two portions 3, 4 are attached. In the present embodiment, the hooks 22, 27 are configured such that the rear surface of the display panel portion 4 abuts the front surface of the frame portion 3. The hooks 22, 27 extend in the horizontal direction by a distance substantially equal to the distance between the front surface of the frame portion 3 and the slots 10, 13.

In addition, a lower surface 36 of the first portion 24 of the upper hook 22 which extends from the upper member 15 abuts the upper surface 9 of the upper rail 15 so that the upper hook 22 can locate in the slot 10 in the upper rail 5 when the lower hook 27 is located in the slot 13 in the lower rail 6. Therefore, the height dimension of the display panel portion 4 is larger than the height dimension of the frame portion 3 by the thickness of the first portion 24 of the upper hook 22. In addition, the width dimensions of the frame portion 3 and the display panel portion 4 are equal. Therefore, the display panel portion 4 has substantially the same height and width dimensions as the frame portion 3 to substantially entirely cover the frame portion 3.

Furthermore, the downwardly extending vertical portion 31 of the lower hook 27 is longer than the second portion 25 of the upper hook 22 so that the lower member 16 can be attached to the lower rail 6 before the upper member 15 of the display frame portion 4 is rotated towards the upper rail 5 so that the upper hook 22 is located over the slot 10. The display frame portion is then moved downwards to fully locate the hooks 22, 27 in the slots 10, 13. Therefore, a bar section can be assembled without the use of tools.

Figure 4:
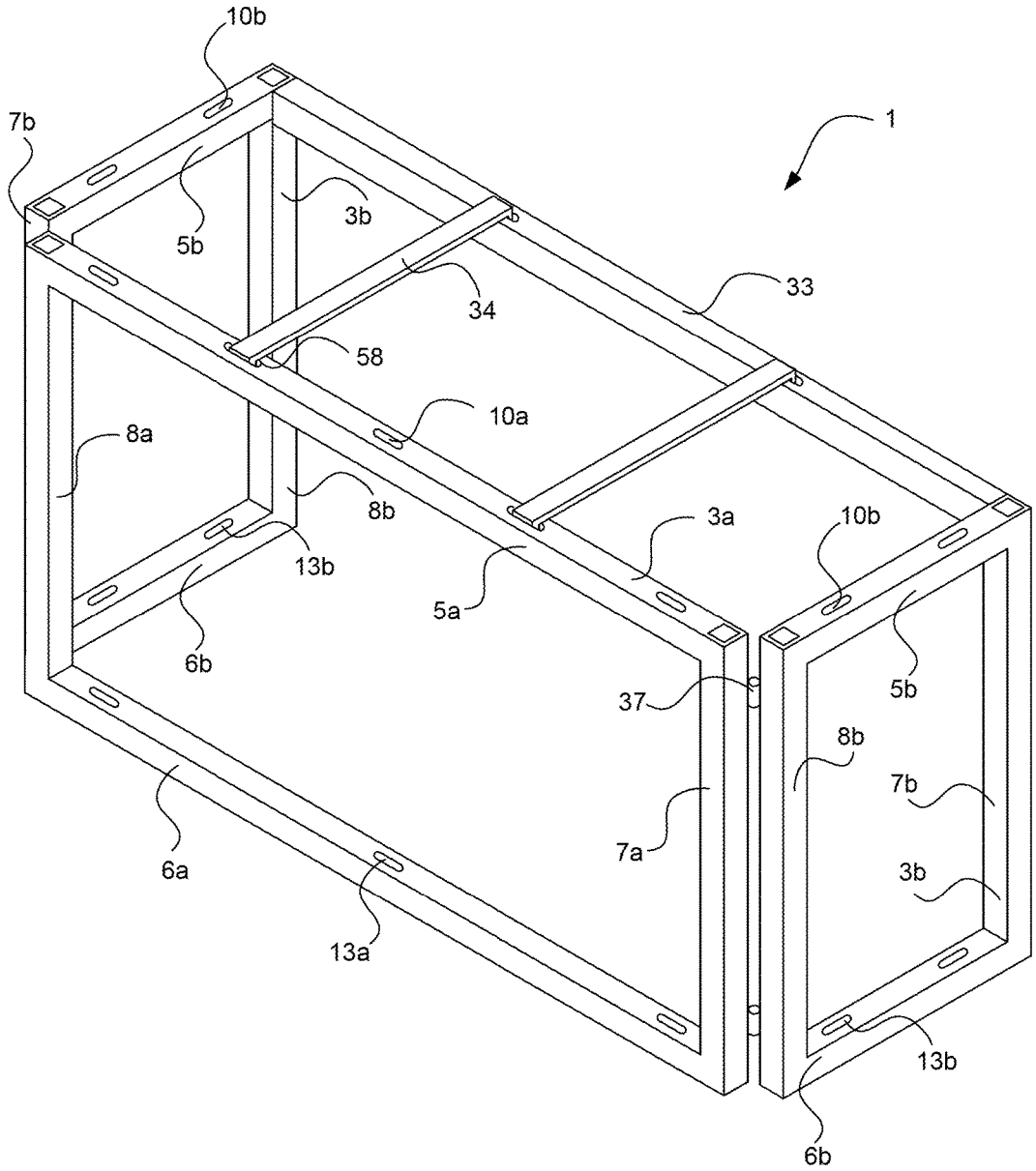
FIG. 4 shows a front frame portion connected to two side frame portions and a positioning bar to form one embodiment of a modular bar.

Referring now to FIG. 4, a perspective view of a partly formed bar module 1 is shown. The partly formed bar module 1 comprises a front frame portion 3*a* hingedly connected to two side frame portions 3*b*. The front and side frame portions 3*a*, 3*b* are formed by frame portions 3 as described above with reference to FIG. 1.

In the present embodiment, a side rail 7*a* of the front frame portion 3*a* is hingedly connected to a side rail 8*b* of the side frame portion 3*b*. The hinge 37 has two leaves (not shown); one of which is attached to the rear inward facing surface (not shown) of the side rail 7*a* of the front frame portion 3*a* and one which is attached to the rear inward facing surface of the side rail 8*b* of the side frame portion 3*b*. The opposing side rail 8*a* of the front frame portion 3*a* is hingedly connected to the side rail 7*b* of the other side frame portion 3*b* in a similar manner.

As shown in FIG. 4, the height of the front frame portion 3*a* is equal to that of the side frame portions 3*b*. However, the overall width dimension of the front frame portion 3*a* is greater than that of the side frame portions 3*b*. Preferably, the width of the side frame portions 3*b* are no bigger than half the width of the front frame portion 3*a* so that they can be rotated into a storage position in which the rear surface of the side frame portions 3*b* abut the rear surface of the front frame portion 3*a*. Alternatively, the side frame portions 3*b* may be rotated so that they overlap. For example, the rear surface of the side rail 8*b* of one side frame portion 3*b* may abut the rear surface of the side rail 7*a* and the rear surface of the side rail 7*b* of the opposing side frame portion 3*b* may abut the front outward facing surface of the side rail 8*b* in another storage position.

In the present embodiment, the upper and lower rails 5*a*, 6*a* of the front frame portion 3*a* comprises three slots 10*a*, 13*a* each which are configured to receive hooks 22, 27. In the present embodiment, the upper rail 5*a* further comprises two more additional slots 58. Each additional slot 58 is located between the slots 10*a* which are configured to receive the display panel portion 4. The upper and lower rails 5*b*, 6*b* of the side frame portion 3*b* comprises two slots 10*b*, 13*b* each.

The bar module 1 further comprise a positioning beam 33 configured to position the unhinged end of the side frame portions 3*b* relative to each other. For example, the positioning beam 33 may hold the side frame portions 3*b* perpendicular to the front frame portion 3*a*, as shown in FIG. 4. Alternatively, the length and/or shape of the positioning beam 33 may be changed such that it holds the side frame portions 3*b* at a 45 degree angle to the front frame portion 3*a* so that the side frame portions 3*b* flare outwards when viewed from the front. In another alternative embodiment, the positioning beam 33 may hold the side frame portions 3*b* relative to the front frame portion 3*a* such that the frame portions 3*a*, 3*b* form a generally triangular shape. The positioning beam 33 may have pins (not shown) extending from its ends which locate in notches (not shown) in the upper 5*b* or side rails 7*b*, 8*b* of the side frame portions 3*b*. In one embodiment, the positioning beam 33 may also comprises a fork (not shown) projecting vertically downwards from its ends which locate over a pin (not shown) extending from the rear surface of the side rails 7*b*, 8*b* at the unhinged end of the side frame portions 3*b*.

The positioning beam 33 also has additional slots 58 in its upper surface which are located opposite the additional slots 58 on the upper rail 5 of the frame portion 3. The additional slots 58 are configured to receive a cross beam 34 using hooks similar to those described extending from the upper member 15 of the display panel portion 4. The positioning beam 33 and the cross beams 34 serve to provide support for a display panel 21 or work surface, described in more detail hereinafter, to prevent flexing of the panel 21 during use. There may be more than one cross beam 34 depending on the width of the front frame portion 3*a*, as shown in FIG. 4.

It will be understood that similar positioning beams may be positioned to extend between the opposing free rails 7*b*, 8*b* of the side frame portions 3*b* at any height as long as the required combination of pins, notches, and/or forks (not shown) are present. Similarly, the required combination of pins, notches, and/or forks may be present on the inner side surfaces of the side rails 7*a*, 8*a* of the frame portion 3 such that a positioning beam 33 may be placed on the front frame portion 3*a*. Therefore, cross beams 34 can be attached between two positioning beams 33 and covered with a horizontal panel to form a shelf (not shown) in the portable bar module 1.

Furthermore, it will be understood that the positioning beam(s) 33 and the cross beams 34 may be integrally formed or welded so that they can be fitted as one piece and without the use of tools.

Figure 5:
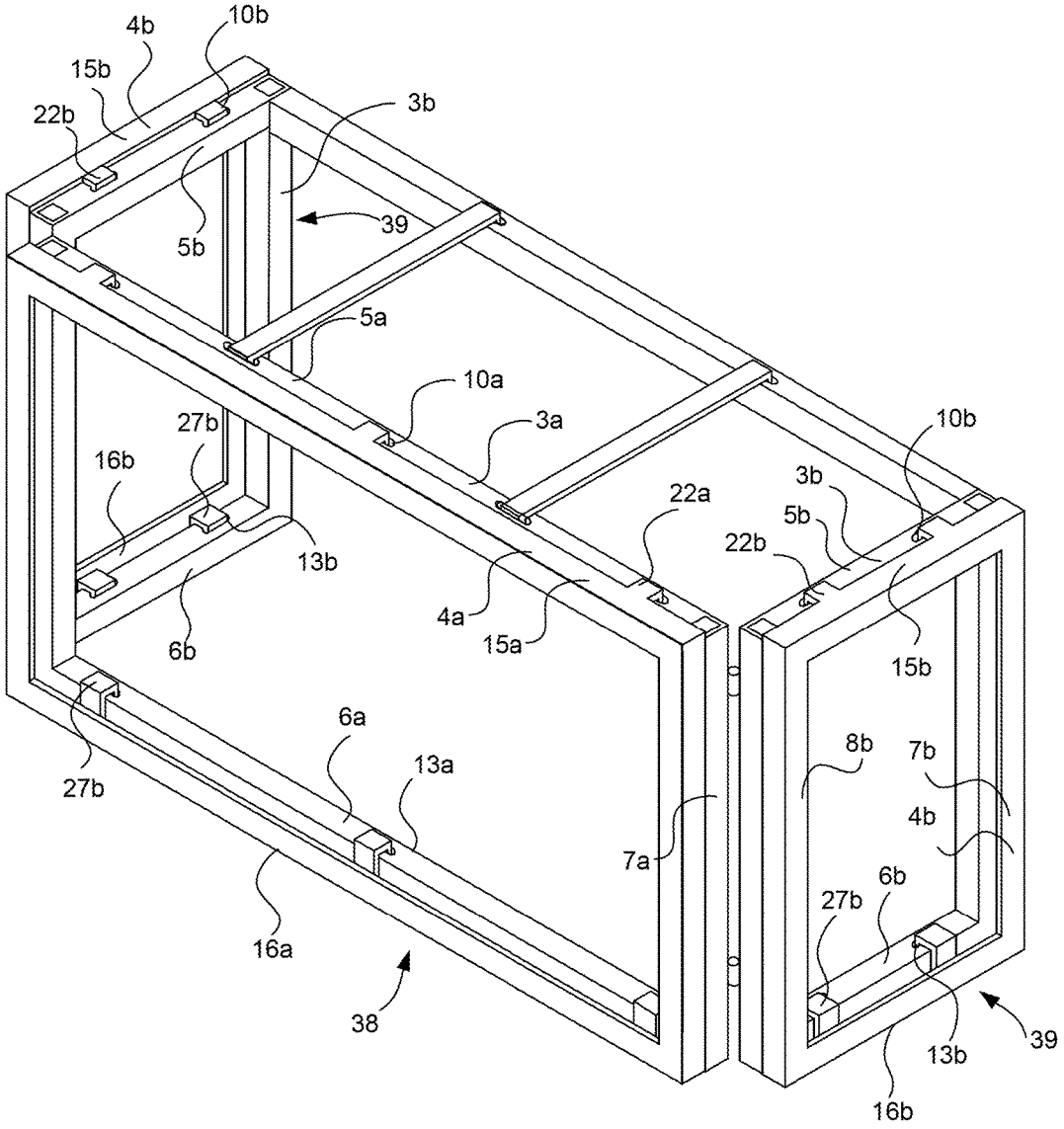
FIG. 5 shows front and side display panel portions mounted to the frame portions of the modular bar shown in FIG. 4.

Referring now to FIG. 5, a perspective view of the partly formed bar module 1 is shown in which the frame portions 3*a*, 3*b* are connected to a front display panel portions 4*a* and two side display panel portions 4*b* with the display panel 21, shown in FIG. 6, omitted. The front and side display panel portions 4*a*, 4*b* are formed by display panel portions 4 as described above with reference to FIG. 2. The combination of the front frame portion 3*a* and front display panel portion 4*a* forms a front bar section 38. The combination of the side frame portion 3*b* and the side display panel portion 4*b* forms a side bar section 39.

In the present embodiment, the upper and lower members 15*a*, 16*a* of the front display panel portion 4*a* comprise three hooks 22*a*, 27*a* each to cooperate with three slots 10*a*, 13*a* in the upper and lower rails 5*a*, 6*a* of the front frame portion 3*a*. The upper and lower members 15*b*, 16*b* of the side display panel portions 4*b* comprise two hooks 22*b*, 27*b* each to cooperate with two slots 10*b*, 13*b* in the upper and lower rails 5*b*, 6*b* of the side frame portion 3*b*. FIG. 6 shows a perspective view of the partly formed bar module 1 in which the display panels 21*a*, 21*b* have been placed in the display panel portions 4*a*, 4*b* and the positioning beam and cross beams have been omitted. Therefore the bar sections 38, 39 of the bar module 1 can be formed without the use of tools.

The bar module 1 may further comprise a corner section 40, shown in FIG. 7 to FIG. 10, which is configured to prevent outward rotation of the side bar sections 39 relative to the front bar section 38. That is, the corner section 40 defines the minimum angle at which the side bar section 39 extends relative to the front bar section 38. Furthermore, the corner section 40 is configured to conceal the hinges 37 connecting the front and side frame portions 3*a*, 3*b* and outward facing side surfaces of the front and side bar sections 38, 39.

Figure 7:
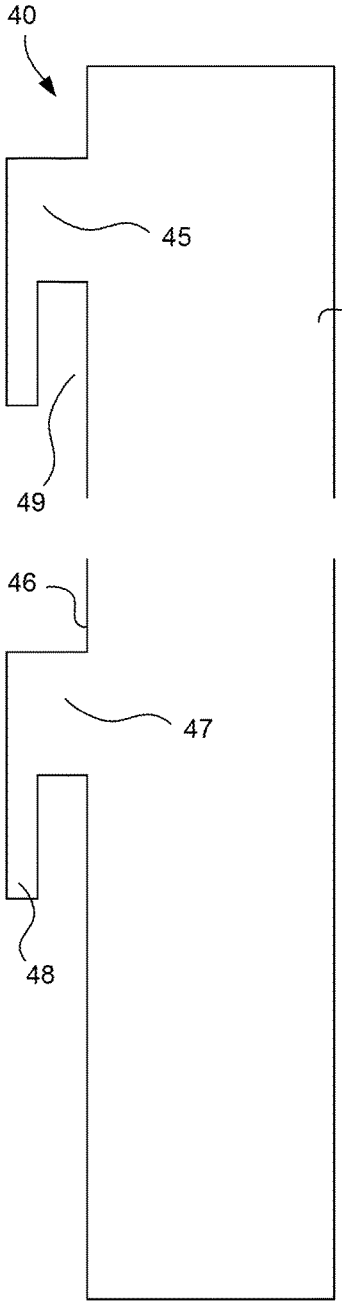
FIG. 7 shows a side view of a corner piece of the modular bar.
Figure 8:
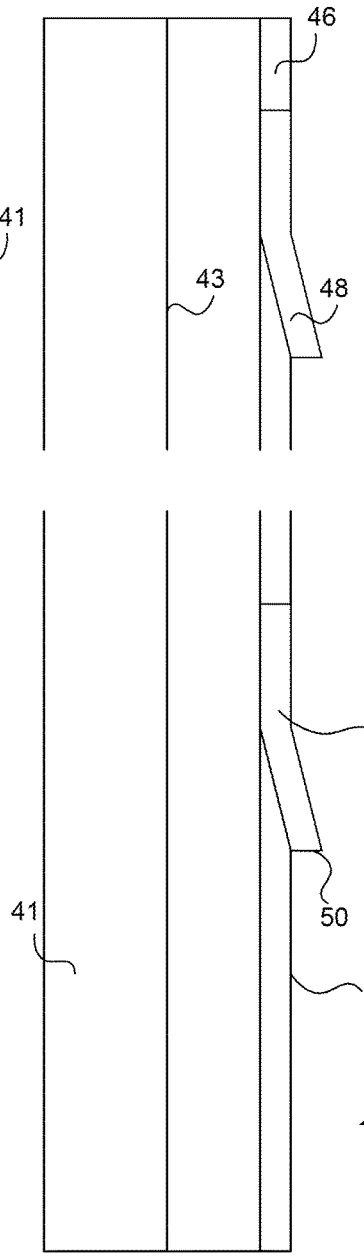
FIG. 8 shows a rear view of the corner piece shown in FIG. 7.

FIG. 7 and FIG. 8 show a side view and a rear view of an exemplary corner section 40. The corner section 40 comprises a main body portion 41 which is tubular, as shown in the top view illustrated in FIG. 9. In the present embodiment, the main body 41 of the corner section 40 has a generally square cross section so that the smallest that the angle can be between the front bar section 38 and the side bar section 39 is 90 degrees. In an alternative embodiment, the corner section may have a generally triangular cross-section so that the smallest that the angle can be between the front bar section 38 and the side bar section 39 is between 15 and 120 degrees, preferably between 30 and 60 degrees.

Figure 9:
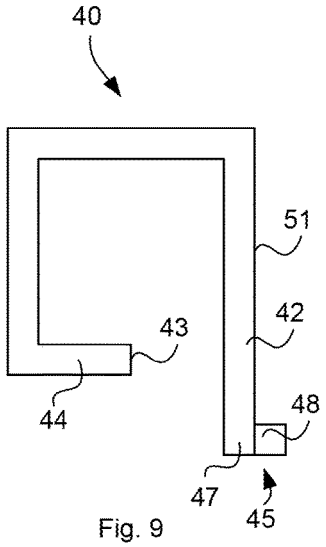
FIG. 9 shows a top view of the corner piece shown in FIG. 8.

A side wall 42 of the main body portion 41 overlaps an end surface 43 of an adjacent side wall 44. The corner section 40 further comprises a hook 45 which extends from an end surface 46 of the overlapping side wall 42. The hook 45 is configured to extend through the gap between the front bar section 38 and side bar section 39 and locate over the hinge 37, shown in FIG. 6. The hook 45 comprises a first section 47 that extends horizontally from the end surface 46 of the side wall 42 and a second section 48 which extends downwards from the first section 47 such that there is a space 49 between the second section 48 and the end surface 46 of the side wall 42 to receive the hinge 37. As shown in FIG. 8 and FIG. 9, the second section 48 of the hook 45 may extend at an angle to the vertical so that its lower end 50 protrudes beyond the plane of an outer surface 51 of the overlapping side wall 42. In an alternative embodiment, the second section 48 of the hook 45 may extend vertically. The corner section 40 may comprise more than one hook 45 to correspond to the number of hinges 37. By using hooks 45, the bar sections 38, 39 and corner sections 40 of the modular bar 1 can be assembled without the use of tools.

Figure 10:
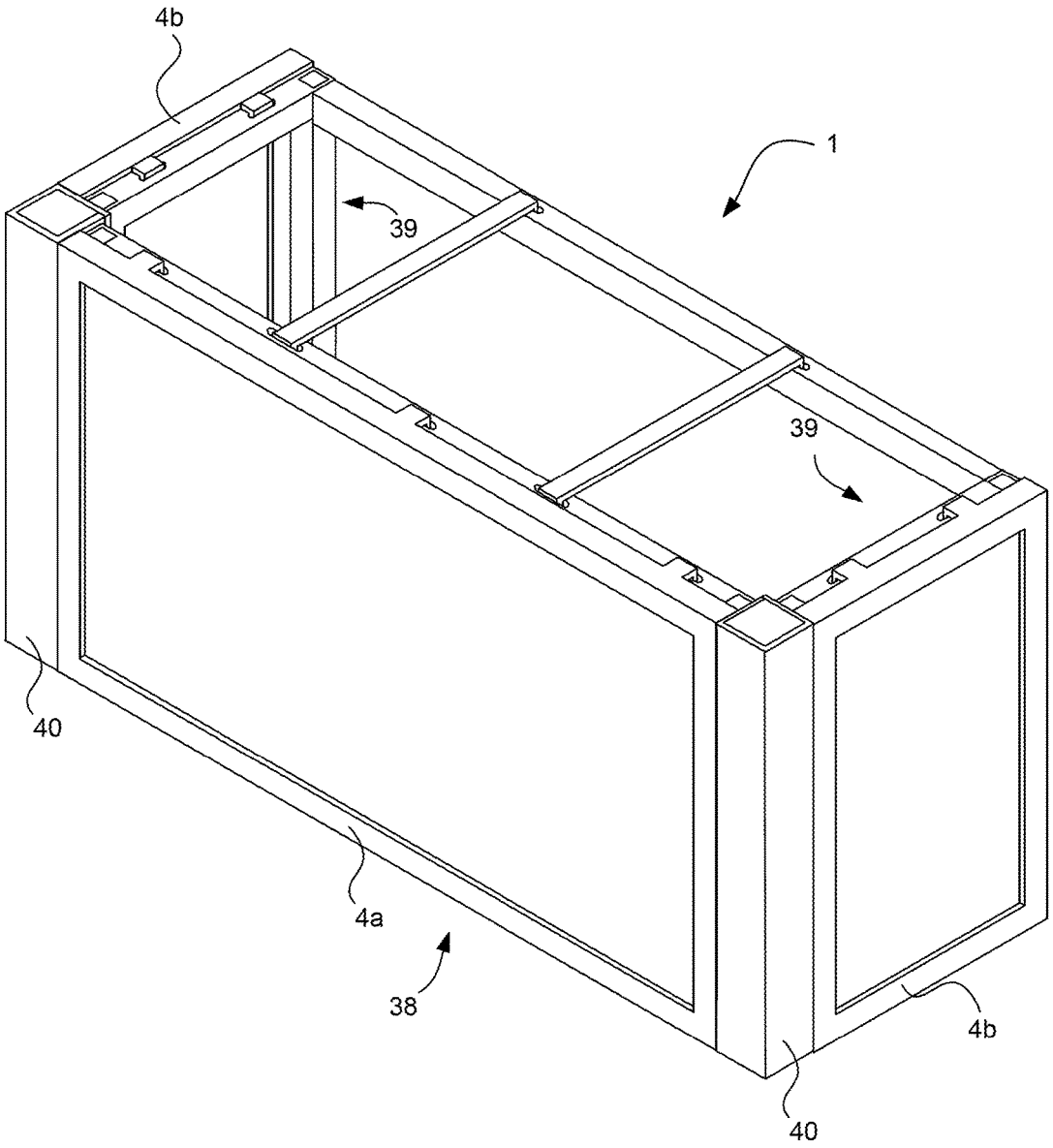
FIG. 10 shows the modular bar of FIG. 6 with corner pieces and the positioning bar.

Referring now to FIG. 10, the partly assembled bar module 1 can be seen with corner sections 40 located between the front bar portion 38 and the side bar portions 39. One outer surface of the corner section 40 abuts the side surfaces of the front bar section 38 and another of the outer surfaces abuts the side surfaces of the side bar section 39. The square shape of the corner sections 40 mean that the side bar sections 39 extends perpendicularly to the front bar section 38. The space 49 is sized so that when the hooks 45 are located over the hinges 37 the corner section 40 is forced against the bar portions 38, 39. In the present embodiment, the corner sections 40 have the same height dimension as the display frame portions 4*a*, 4*b* and the same width as the front and side bar sections 38, 39. That is, the width of the corner section 40 is the same as the width of the frame portion 3 and display panel portion 4.

Figure 11:
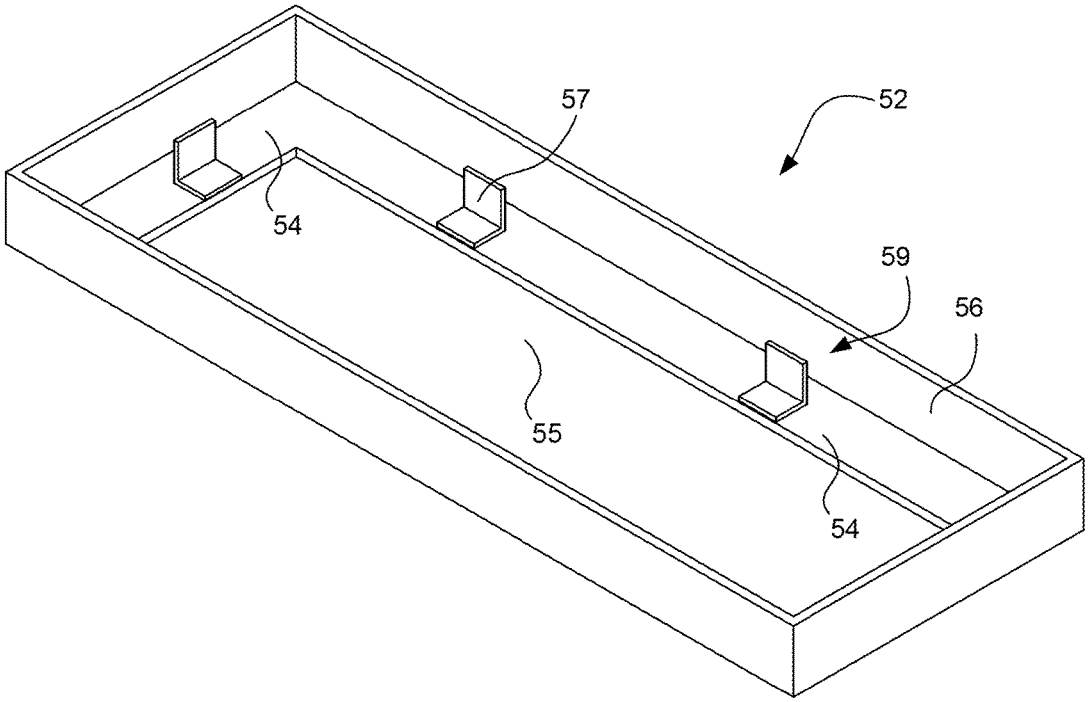
FIG. 11 shows a cover frame for the modular bar.

Referring now to FIG. 11, a perspective bottom view of a cover frame 52 of a cover 53, shown in FIG. 12 with its work surface, is shown. The cover frame 52 of the cover 53 is configured to sit on the top of the bar sections 38, 39. In one embodiment, the cover frame 52 may also sit on top of the positioning and cross beams 33, 34, shown in FIG. 5. The cover frame 52 comprises four members 54 arranged in a generally rectangular shape with a rectangular aperture 55 in the centre. The cover frame 52 further comprises a peripheral lip 56 which extends vertically from the outer edge of the rectangular members 54 and is configured to fit around the upper part of the front and side bar sections 38, 39. In an alternative embodiment, the cover frame 52 is sized so that the peripheral lip 56 fits around the front and side bar sections 38, 39 and the corner section 40 that positions them relative to each other.

The underside of the cover frame 52 may further comprise a vertically extending projection 57 configured to help correctly locate the cover frame 52 of the cover 53. Each member 54 may comprise at least one projection 57. The projection may be vertically extending or L-shaped as shown. When the cover frame 52 is placed on the bar sections 38, 39, the projections 57 are located outside of the upper rail 5 of the frame portion 3 upper member 15 of the display panel portion 4, positioning beam 33 and work surface or display panel 21. By using projections 57, the bar sections 38, 39, corner sections 40, positioning beam 33, and cover 53 of the modular bar 1 can be assembled without the use of tools.

As seen in FIG. 11, there is a gap 59 between the projections and the peripheral lip 56. In some embodiments, LED lights (not shown) may be placed in the gap 59 to illuminate the display panels 21 of the bar module 1.

As shown in FIG. 12, which illustrates a fully assembled bar module 1, a display panel 21, or branded work surface, can be placed in the cover frame 52 to rest on top of the bar sections 38, 39, positioning beam 33 and cross beams 34.

It will be understood that a plurality of bar modules 1 can be placed together to form a larger bar. It will also be understood that the bar modules 1 may have a different shapes in alternative embodiments. For example, it is envisaged that the side bar section 38 of the bar module 1 may extend at a 45 degree angle to the front bar section 39. Therefore, the corner sections 40 will be triangular instead of square and the cover 53 will also take a different shape. In another alternative embodiment, the bar module 1 may be square, such that the front bar section 38 is the same width as the side bar section 39, triangular, or curved i.e. U shaped. It will be appreciated that all embodiments of the bar module 35 may be used together to form a bar of various shapes and sizes or may stand alone.

ASPECTS OF THE INVENTION

Aspect 1: A bar section for a portable modular bar comprising:

a frame portion having spaced upper and lower rails connected by opposing side rails, the upper rail comprising a slot extending into its upper surface, and a display panel portion comprising a hook configured to cooperate with the slot in the frame portion in order to mount the display panel portion on the frame portion.

Aspect 2: The bar section according to Aspect 1, wherein the hook extends in a horizontal direction from the display panel portion and is configured such that a rear surface of the display panel frame contacts the front surface of the frame portion.

Aspect 3: The bar section according to Aspect 2, wherein the hook extends in the horizontal direction by a distance substantially equal to the distance between the front surface of the frame portion and the slot.

Aspect 4: The bar section according to any one of the preceding Aspects, wherein the hook extends horizontally from the rear surface of an upper member of the display frame portion.

Aspect 5: The bar section according to any one of the preceding Aspects, wherein the hook comprises a first portion which extends horizontally from the rear face of the display panel portion and a second portion which extends vertically downwards from a free end of the first portion and is configured to be located in the slot when the display panel portion is mounted on the frame portion.

Aspect 6: The bar section according to any one of the preceding Aspects, wherein the display panel frame has substantially the same height and width dimensions as the frame portion to substantially entirely cover the frame portion.

Aspect 7: The bar section according to any one of the preceding Aspects, wherein the frame portion comprises more than one slot and the display panel portion comprises a hook configured to cooperate with each slot.

Aspect 8: The bar section according to any one of the preceding Aspects, wherein the lower rail comprises a slot extending into its upper surface and the display panel portion comprises a hook configured to cooperate with the slot in the lower rail.

Aspect 9: The bar section according to Aspect 8, wherein the lower hook comprises a first portion extending substantially vertically from a lower member of the display panel frame, a horizontal portion which extends by a distance substantially equal to the distance between the front surface of the frame portion and the slot, and a downwardly extending vertical portion that is configured to be located in the slot when the display panel portion is mounted on the frame portion.

Aspect 10: The bar section according to any one of the preceding Aspects, wherein the rails are tubular.

Aspect 11: The bar section according to any one of the preceding Aspects, further comprising a display panel configured to be located within the display panel portion.

Aspect 12: A modular bar comprising:

a front bar section according to any one of Aspects 1 to 11, a side bar section according to any of Aspects 1 to 11 hingedly connected to a side rails of the front bar section, and a cover section having a peripheral lip configured to fit around the upper part of the front and side bar sections.

Aspect 13: The modular bar according to Aspect 12, further comprising a corner section configured to prevent the outward rotation of the side bar section relative to the front bar section and conceal the hinge and side surfaces of the front and side bar sections from view.

Aspect 14: The modular bar according to Aspect 13, wherein the corner section comprises a hook configured to locate over the hinge.

Aspect 15: The modular bar according to Aspect 14, wherein a surface of the corner section is flush with the outward facing surface of the front bar section and/or the outward facing surface of the side bar section.

Aspect 16: The modular bar according to one of Aspects 14 or 15, wherein the corner section is substantially tubular and comprises a side wall, from whose end surface the hook extends, which overlaps the end surface of an adjacent side wall.

Aspect 17: The modular bar according to any one of Aspects 14 to 16, wherein the hook comprises a first section that extends horizontally from the end surface of the side wall and a second section which extends downwards from the first section such that there is a space between the second section and the end surface of the side wall.

Aspect 18: The modular bar according to Aspect 17, wherein the second section of the hook extends downwards at an angle to the vertical.

Aspect 19: A modular bar substantially as described herein with reference to the description.

Aspect 20: A modular bar substantially as described herein with reference to the accompanying drawings.

The invention claimed is:

1. A modular bar comprising:

a front bar section comprising a frame portion having spaced upper and lower rails connected by opposing side rails, the upper rail comprising a slot extending into its upper surface, and a display panel portion comprising a hook configured to cooperate with the slot in the frame portion in order to mount the display panel portion on the frame portion;

a side bar section hingedly connected to the front bar section by a hinge, the side bar section comprising a frame portion having spaced upper and lower rails connected by opposing side rails, the upper rail of the side bar section comprising a slot extending into its upper surface, and a display panel portion comprising a hook configured to cooperate with the slot in the frame portion of the side bar section in order to mount the display panel portion of the side bar section on the frame portion thereof; and a corner section comprising a hook configured to locate over the hinge.

2. The modular bar according to claim 1, wherein in at least one of the front bar section or the side bar section the hook thereof extends in a horizontal direction from the display panel portion thereof and is configured such that a rear surface of the display panel frame thereof contacts a front surface of the frame portion thereof.

3. The modular bar according to claim 2, wherein in the at least one of the front bar section or the side bar section the hook thereof extends in the horizontal direction by a distance substantially equal to the distance between the front surface of the frame portion thereof and the slot thereof.

4. The modular bar according to claim 1, wherein in at least one of the front bar section or the side bar section the hook thereof extends horizontally from the rear surface of an upper member of the display frame portion thereof.

5. The modular bar according to claim 1, wherein in at least one of the front bar section or the side bar section the hook thereof comprises a first portion which extends horizontally from a rear face of the display panel portion thereof and a second portion which extends vertically downwards from a free end of the first portion and is configured to be located in the slot thereof when the display panel portion is mounted on the frame portion thereof.

6. The modular bar according to claim 1, wherein in at least one of the front bar section or the side bar section the display panel frame thereof has substantially the same height and width dimensions as the frame portion thereof to substantially entirely cover the frame portion.

7. The modular bar according to claim 1, wherein in at least one of the front bar section or the side bar section the frame portion thereof comprises more than one slot and the display panel portion thereof comprises a hook configured to cooperate with each slot.

8. The modular bar according to claim 1, wherein in at least one of the front bar section or the side bar section the lower rail thereof comprises a slot extending into its upper surface and the display panel portion thereof comprises a lower hook configured to cooperate with the slot in the lower rail thereof.

9. The modular bar according to claim 8, wherein in the at least one of the front bar section or the side bar section the lower hook comprises a first portion extending substantially vertically from a lower member of the display panel frame thereof, a horizontal portion which extends by a distance substantially equal to the distance between the front surface of the frame portion thereof and the slot thereof, and a downwardly extending vertical portion that is configured to be located in the slot thereof when the display panel portion thereof is mounted on the frame portion thereof.

10. The modular bar according to claim 1, wherein in at least one of the front bar section or the side bar section the rails are tubular.

11. The modular bar according to claim 1, at least one of the front bar section or the side bar section further comprising a display panel configured to be located within the display panel portion thereof.

12. The modular bar according to claim 1, wherein the side bar section is hingedly connected to at least one of the side rails of the front bar section, the modular bar further comprising a cover section having a peripheral lip configured to fit around the upper part of the front and side bar sections.

13. The modular bar according to claim 1, wherein the corner section is configured to prevent the outward rotation of the side bar section relative to the front bar section and conceal the hinge and side surfaces of the front and side bar sections from view.

14. The modular bar according to claim 1, wherein a surface of the corner section is flush with an outward facing surface of the front bar section or an outward facing surface of the side bar section.

15. The modular bar according to claim 1, wherein the corner section is substantially tubular and comprises a side wall, from whose end surface the hook thereof extends, which overlaps the end surface of an adjacent side wall.

16. The modular bar according to claim 1, wherein the hook of the corner section comprises a first section that extends horizontally from the end surface of the side wall thereof and a second section which extends downwards from the first section such that there is a space between the second section and the end surface of the side wall thereof.

17. The modular bar according to claim 16, wherein the second section of the hook extends downwards at an angle to the vertical.

18. A bar section for a portable modular bar, the bar section comprising a frame portion having spaced upper and lower rails connected by opposing side rails, the upper rail comprising a slot extending into its upper surface, and a display panel portion comprising a hook configured to cooperate with the slot in the frame portion in order to mount the display panel portion on the frame portion, the lower rail comprising a slot extending into its upper surface and the display panel portion comprising a lower hook configured to cooperate with the slot in the lower rail, the lower hook comprising a first portion extending substantially vertically from a lower member of the display panel frame, a horizontal portion which extends by a distance substantially equal to the distance between the front surface of the frame portion and the slot, and a downwardly extending vertical portion that is configured to be located in the slot when the display panel portion is mounted on the frame portion.

* * * * *